US008376026B2

(12) United States Patent
Zheng et al.

(10) Patent No.: US 8,376,026 B2
(45) Date of Patent: Feb. 19, 2013

(54) THIXOTROPIC INJECTOR WITH IMPROVED ANNULAR TRAP

(75) Inventors: Chang-Qing Zheng, Chicoutimi (CA); Dany Drolet, Chicoutimi (CA)

(73) Assignee: National Research Council of Canada, Ottawa, ON (CA)

( * ) Notice: Subject to any disclaimer, the term of this patent is extended or adjusted under 35 U.S.C. 154(b) by 0 days.

(21) Appl. No.: 12/786,824

(22) Filed: May 25, 2010

(65) Prior Publication Data

US 2011/0186260 A1 Aug. 4, 2011

Related U.S. Application Data

(60) Provisional application No. 61/282,372, filed on Jan. 29, 2010.

(51) Int. Cl.
*B22D 17/10* (2006.01)
*B22D 23/00* (2006.01)

(52) U.S. Cl. ..... 164/312; 164/113; 164/900

(58) Field of Classification Search ..... 164/113, 164/312, 900
See application file for complete search history.

(56) References Cited

U.S. PATENT DOCUMENTS

| | | | | |
|---|---|---|---|---|
| 5,730,201 | A | 3/1998 | Rollin et al. | |
| 6,230,786 | B1 * | 5/2001 | Choshi | 164/312 |
| 6,382,302 | B1 * | 5/2002 | Imwinkelried | 164/312 |
| 6,554,057 | B1 | 4/2003 | Arnold et al. | |
| 7,299,854 | B2 * | 11/2007 | Kamm et al. | 164/113 |
| 7,341,094 | B2 * | 3/2008 | Manda | 164/312 |
| 8,047,258 | B1 | 11/2011 | Zeimet et al. | |
| 2006/0196626 | A1 * | 9/2006 | Decker et al. | 164/312 |
| 2011/0108231 | A1 * | 5/2011 | Zheng et al. | 164/312 |

FOREIGN PATENT DOCUMENTS

DE 19507995 12/1995

OTHER PUBLICATIONS

International Search Report and Written Opinion; PCT/CA2011/000102; Mailing date May 17, 2011.

Machine translation into English of DE19507995 to Jung P. et al, Dec. 7, 1995.

* cited by examiner

*Primary Examiner* — Devang R Patel

(74) *Attorney, Agent, or Firm* — Jason E. Davis

(57) ABSTRACT

By blocking an angular extent of an annular skimming trap used for semi-solid injection, a notable reduction in lenticular defects and porosity are observed. The blocking can be performed by a ring having dimensions to completely occlude a prior art annular skimming trap throughout the angular extent, and providing complete and/or partial flow across the ring throughout the rest of the angular extent. Preferably an outlet to the ring trap includes a chamfered edge and/or a deflector for encouraging flow of the contaminated semi-solid material into the trap.

13 Claims, 3 Drawing Sheets

THIXOTROPIC INJECTOR WITH IMPROVED ANNULAR TRAP

CROSS-REFERENCE TO RELATED APPLICATIONS

This application claims the benefit of United States Provisional Patent Application U.S. Ser. No. 61/282,372 filed Jan. 29, 2010, the entire contents of which are herein incorporated by reference.

FIELD OF THE INVENTION

The present invention relates in general to die casting, and, in particular, to an injector for communicating a billet of semisolid material between a piston chamber, and a mold, wherein the injector has a partial annular skimmer that does not completely encircle an exit of the injector, but completely obstructs flow at one range of angles, to efficiently guide a contaminated material, preferentially formed on one side of the billet, into a trap.

BACKGROUND OF THE INVENTION

Forming and casting of semi-solid metal, and like thixotropic materials is an important technology that has a growing number of applications, such as in motor vehicles such as in engine mounts, suspension brackets, and cylinder housings. While excellent reproducibility, lower temperature operation, and near net shape processing are the principle advantages of this technology, for certain low tolerance, high quality applications, inclusions remain a problem.

Generally thixotropic material forming and casting involves loading a billet into a piston chamber, and thrusting a piston into the piston chamber to propel the billet through an injector into one or more mold cavities. Lubricants are often used to facilitate reciprocation of the piston (or like element) by reducing resistance to the motion from the billet and piston bearing against the chamber. Depending on the billet and the environmental conditions, a skin of varying thickness, mechanical properties, and having various layers are typically formed. The layers of the skin may have respective impurities, and may pose problems for uniform filling of the molds. In horizontal injection systems, the piston and chamber containing the injection matter (often called a sleeve) are oriented so that the piston moves horizontally. The lubricant used on the piston and container walls may accumulate on the bottom of the container.

Inclusion-type defects, due to the skin or layers thereof being entrained in the flow, are some of the major problems associated with forming processes where the injector includes a throttling neck. When the matter is being injected, the skin layers can get into the parts or finished products, where they remain trapped. The skin may have lubricant or other impurities that lead to inclusions. Inclusions are one of the major defects found in formed parts. They can significantly reduce the quality and mechanical properties of the parts.

The lubricants in particular can aggravate the inclusion problem by contaminating surfaces. Lubricant traces get into the parts or finished products along with the outside layers. When a part containing lubricant is heated, the lubricant may decompose and create oval or half-moon porosities referred to as lenticular porosities. Heat treatment is often used on parts made using semi-solid metal casting to increase their mechanical properties.

Another phenomenon occurring during injection, under the effect of heat transfer, is that the outside of the injected matter is rapidly cooled by contact, thus creating a relatively hard, or pre-solidified, layer.

One solution well known in the art is to provide an oxide trap. The most commonly deployed oxide traps are annular skimming ring tanks that surround the neck radially, and use an edge at the base of the throttling neck to direct a skin of the billet radially into the ring tank, such that it is excluded from the neck, and so is not delivered to the mold. Applicant has found that using such annular skimming tanks, presolidified skin backs up in a dead-zone forming a ramp that actually encourages skin to be entrained into the neck, to the detriment of the forming process.

U.S. Pat. No. 5,730,201 to Rollin et al. teaches an improved oxide trap. According to the teachings of Rollin et al. before introducing the thixotropic metal alloy into mold cavity, the oxide skin surrounding the metal billet is removed completely and collected in an oxide deposit ring. Rollin et al. strives to minimize the removal of oxide-free, homogeneous thixotropic metal alloy, by taking into account the thermal and mechanical properties of the thixotropic billet, which are asymmetric with respect to the longitudinal axis of the metal billet. While it is stated that an essentially uniformly thick oxide skin is formed over the whole of the thixotropic metal billet, it makes mechanical and thermal contact with the casting chamber wall over only a small area on its undermost side. More heat is lost by the billet there. Rollin et al. reasons that optimal removal of the oxide skin requires accounting for asymmetric (with respect to the longitudinal axis of the metal billet) thermal and mechanical properties of the oxide skin. According to Rollin et al., the thixotropic metal alloy is led through a ring-shaped body situated between the casting chamber and the mold. It is stated to be essential to the invention that while removing a constant amount of oxide over the whole peripheral region of the billet, the oxide remover opening features a cross-section that is asymmetric with respect to the concentric middle axis of the oxide remover, such that the lower part of the horizontal ring-shaped oxide remover is larger than that of the upper part.

Rollin et al. also teach a recess 44, preferably situated in the lower part of the oxide remover opening 42, arranged to enlarge a cross-section of the opening in this lower region, and serves to provide better guide the oxide skin into the corresponding part of the oxide deposit ring 40. The preferred example of the recess has an angular extent of 65° with respect to the axis.

While Rollin et al. claim that shaped parts manufactured by their process typically exhibit a porosity of less than 1 vol. % and an oxide fraction of 0-3 wt. %, and preferably 0-1 wt. %, the requirement to remove an annular sheath is expensive and wasteful. The method according to Rollin et al. produces a thickened oxide layer, and superheats the skin (inevitable given induction heating), which leads to less uniform billets. There remains a need for an effective oxide remover for thixotropic material injectors around a throttling neck.

SUMMARY OF THE INVENTION

Applicant has demonstrated that a partial annular oxide skimmer has considerable advantages over the prior art in that it is highly effective at removing inclusion-type defects while limiting the amount of removed material. This discovery was made based on the understanding that a dead-zone, a region of low velocity flow between the opening of the annular trough and the neck where skin backs up, produces a ramp of more solid material that actually encourages skin to enter the exit of the standard annular oxide remover. This skimmer is capable of efficiently trapping pre-solidified contaminated skin layers, with the accumulated lubricant during the injection process with less collected volume over the prior art.

Accordingly an injector for injecting a thixotropic billet from a piston chamber into a mold is provided. The injector has a piston chamber segment, an entry channel having a smaller diameter than the piston chamber segment, and a skimmer near a periphery of the piston chamber segment proximate the entry channel. The skimmer is coupled by an outlet to a trap. The outlet extends 10-70% around a center axis of the injector. The trap may be a ring tank that extends around the center axis to a greater extent than the skimmer. The injector's center axis may be oriented horizontally in use and the skimmer may be centered vertically on a bottom of the injector to gather at least a part of a skin formed on a bottom of the billet. The injector may have only two parts. Preferably the skimmer is defined in the first part as an edge between a deflector and/or an edge between the cylindrical wall and the outlet is chamfered with an angle of 60° or less to improve flow of at least a part of a skin formed on the billet.

Also accordingly a method for removing at least a part of a skin formed on a thixotropic billet during injection of the billet is provided. The method involves thrusting the billet through a constriction in an injector between a piston chamber segment, and an entry channel having a smaller diameter than the piston chamber segment; and skimming the billet to selectively remove at least part of the skin around 10-70% of the periphery of the billet near the constriction. The thrusting the billet may be facilitated by concentric alignment of the piston chamber segment and entry channel. The thrusting may be facilitated by lubricating a piston chamber. Selectively removing preferably includes guiding the at least part of the skin through an output to a trap.

Furthermore, an insert for a thixotropic injector is provided. The insert has a ring shape with an inner diameter greater than a diameter of an entry channel of the injector, and an outer diameter greater than that of a piston chamber section of the injector, but able to fit within the injector. The insert has open and closed sections: the closed section having a thickness of an opening of a ring tank of the injector, at least between the periphery of the piston chamber section and the ring tank, to effectively close the opening; and the open section having a thickness less than that of the opening of the ring tank to permit flow of a skimmed material throughout the open section. The closed section may occupy 30-90% of the angular extent of the ring.

BRIEF DESCRIPTION OF THE DRAWINGS

In order that the invention may be more clearly understood, embodiments thereof will now be described in detail by way of example, with reference to the accompanying drawings, in which.

DETAILED DESCRIPTION OF THE PREFERRED EMBODIMENTS

The present invention provides improved annular skimming for effectively removing contaminated layers of a thixotropic material, the improvement including partially obstructing a path between the injector and the tank to provide access to the tank only across an angular extent of the injector where the material is contaminated. The partial annular skimming is fed to a trap, preferably in the form of a ring tank, that is capable of efficiently trapping the contaminated outside layer throughout the injection process.

Figure 1:
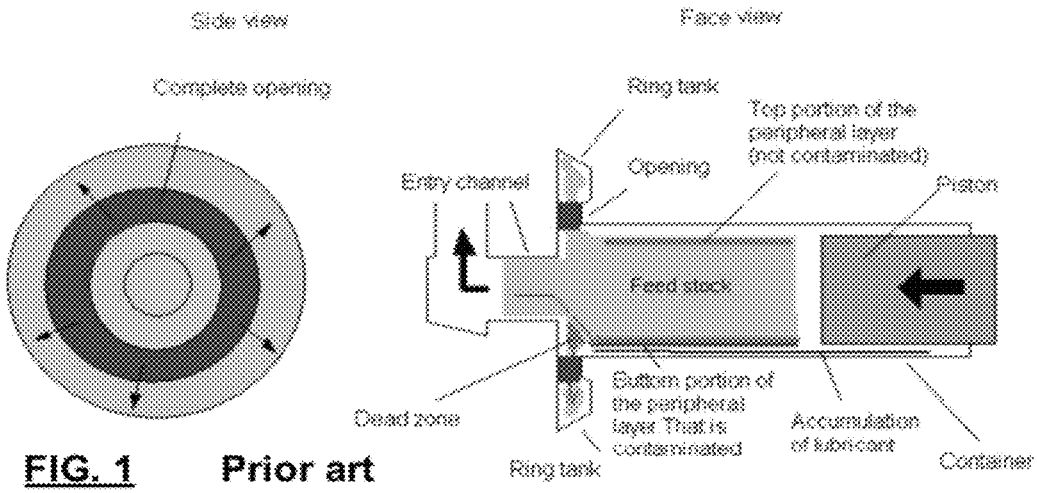
FIG. 1 Prior art
FIG. 1 is a schematic illustration of a prior art thixotropic injector featuring an annular skimming tank surrounding an entry channel that is narrowed with respect to a chamber.

FIG. 1 is a schematic illustration of a prior art thixotropic material injector having a container for receiving a billet, and a piston for thrusting the billet through an entry channel of the injector, which communicates via a sharp angle bend, to a mold (not in view). The entry channel is concentric with the piston, and of a narrower dimension to effectively throttle the material flow. A schematic side view shows 4 concentric regions. The circular inner most region corresponds to the entry channel, which is surrounded by a remainder of the container, which has the larger diameter. A darkened central region surrounding the container illustrates a complete (360° annular opening (as also taught by Rollin et al.) that extends between a ring tank at the outermost area, and the container. Lubricant pooling is shown, along with an oxide layer produced when rheoforming is used, instead of thixoforming (as taught by Rollin et al.). The skimming of material all around the billet leads to substantially more material entering the ring tank and being wasted. This design also leads to back up of the skimmed material to produce, at a region between the entry channel and annular opening (where flow rates are naturally lower during the injection) a dead zone where the material tends to cool more rapidly and form a ramp for skin that reduces efficiency of the annular skimming. This embodiment is compared with the embodiment of FIG. 2 below, in FIGS. 4-5.

Figure 2A:
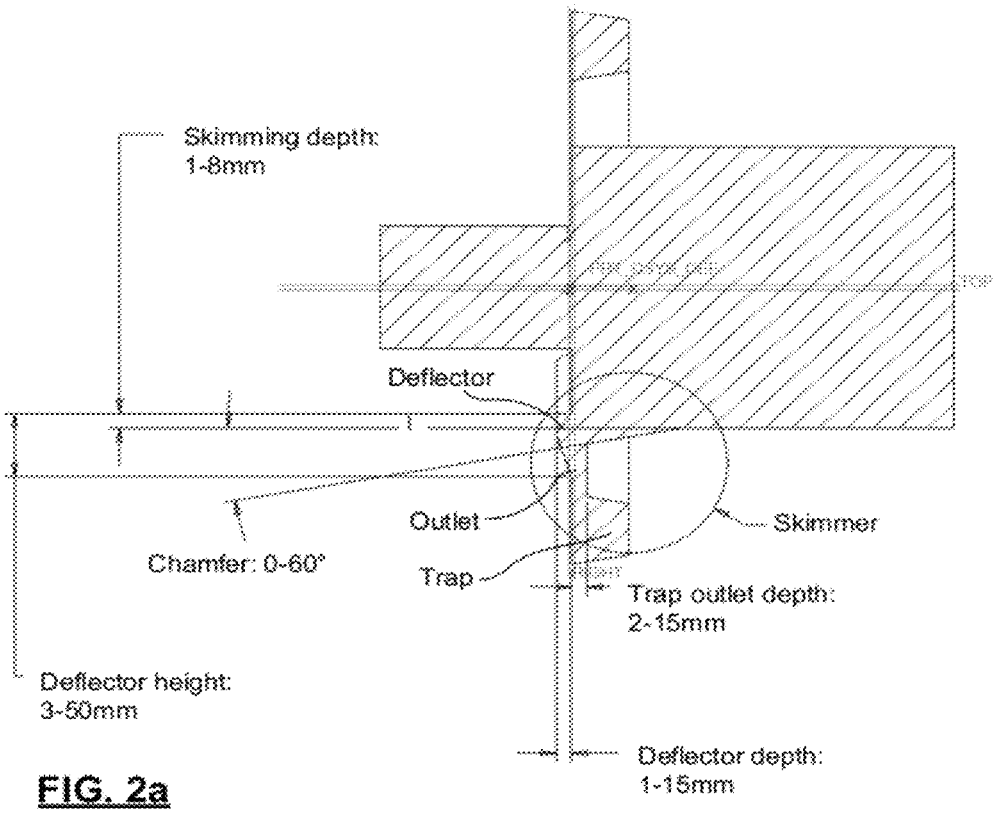
FIGS. 2*a,b* are longitudinal and transverse views of an injector in accordance with an embodiment of the invention, FIG. 2*a* showing flow of material through a partial annular skimming tank, and FIG. 2*b* showing a cross-section through the partial annular skimming tank.
Figure 2B:
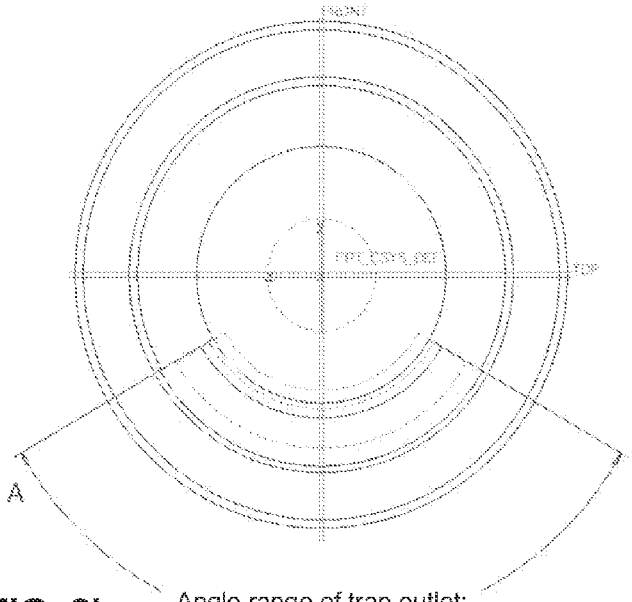

FIGS. 2*a,b* are longitudinal cross-sectional, and transverse cross-sectional views of an injector providing partial annular skimming to a trap with a trap outlet that extends 10-70% around the entry channel. The basic composition of the injector shown in FIG. 2 is much the same as that of FIG. 1, with substantial differences only in the annular skimming. As can best be seen in FIG. 2*b*, the angular extent of the outlet between the ring tank and injector, with respect to a centre axis of the injector, can vary between 36°-252° (120° shown and used in modeling and prototypes below), and is thus partial.

The angular orientation and extent of the outlet is preferably chosen in relation to the lubrication system and the range of the contaminated region, so that the outlet is located only in the area where contaminated matter is found. In many semi-solid processes using horizontal injectors, and most particularly in rheoforming, this coincides with the position where the billet is supported Furthermore a deflector is provided that assists in guiding contaminated skin layers towards the ring tank, the deflector having a skimming depth of 1-8 mm, a height of 3-50 mm, and a depth of 1-15 mm, and may have a variety of profiles, such as the triangular profile shown.

A cylindrical wall of the piston chamber is preferably chamfered in the region of the outlet to cooperate with the deflector to reduce resistance of the skin in entering the trap. The chamfer may be, for example, up to 60°. It is particularly preferred to have at least one of the chamfer and the deflector to encourage flow into the ring tank.

The trap outlet is a channel extending from the piston chamber to the trap (i.e. Dart of the ring tank as shown). The trap depth may be chosen empirically, mostly in dependence on a local viscosity of the material during the injection. If the viscosity of the material is known, numerical simulations can be used to determine the trap depth. In general, the higher the viscosity, the thicker the trap outlet required to effectively convey the skimmed material. The ring tank naturally has to have a volume at least as great as the total volume skimmed to prevent backup of the contaminated layer. A thickness of ~4.5 mm was chosen for the injections performed below, although it could be 1-15 mm for other injections. With correct selection of the thickness of the trap outlet, the ring tank fills progressively throughout the injection, and delays, or avoids, the formation of a dead zone.

It will be noted that by the inclusion of a single ring-shaped insert, the prior art of FIG. 1 can be adapted to provide partial annular skimming in accordance with the invention. The insert would be of dimensions to block the darkened space in FIG. 1 completely over 30-90% of the azimuthal extent of the insert, and to leave it open, at least partially, over the rest. By further chamfering the bottom of the piston chamber section of the injector of FIG. 1 (i.e. the container where it meets the end wall having the entry channel) over the azimuthal extent of the outlet (or a greater or lesser part of the periphery) and by providing a recess in the end wall adjacent the periphery of the piston chamber section, the design of FIG. 2 can be realized.

Figure 3:
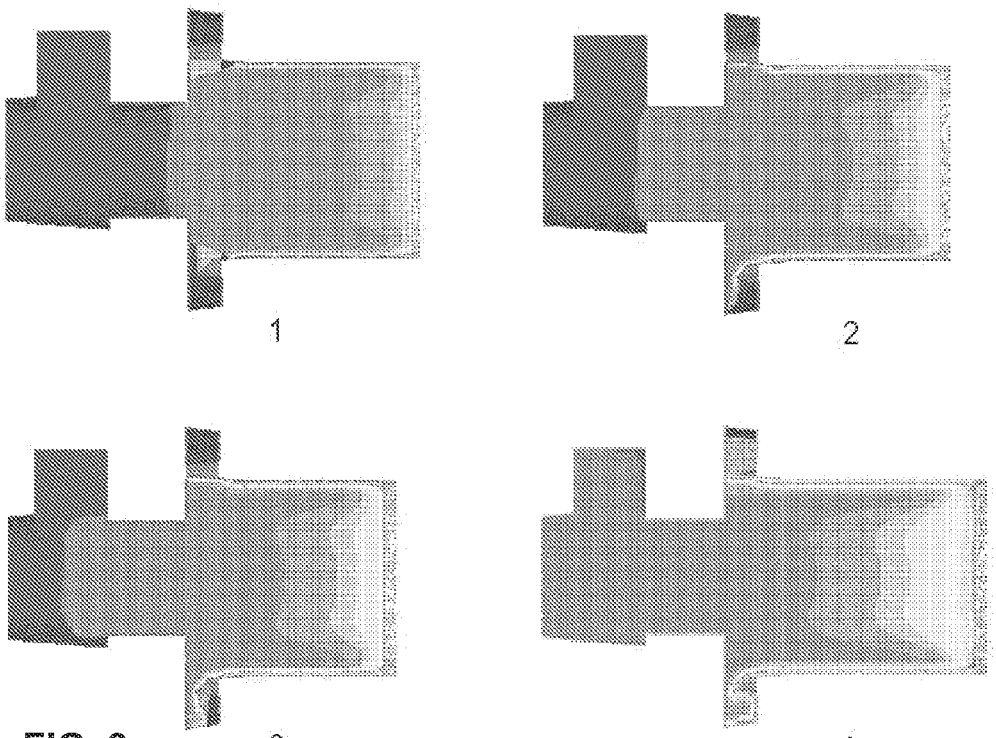
FIG. 3 shows 4 velocity maps of flow through an injector having a partial annular skimming tank at four time points produced by a simulation.

FIG. 3 shows velocity maps of successive steps in injecting a semi-solid metal alloy through an injector of FIG. 1, containing a ring insert to provide partial annular skimming. No deflector or chamfer is provided in this simulation. The flow shows the filling of the ring tank, and how the skin flows initially radially outwardly, and subsequently azimuthally around the ring tank. The flow was performed with a simulation having these parameters:

| | |
|---|---|
| Temperature of mould: | 250° C. |
| Temperature of material: | 585° C. at gate |
| Filling speed (piston): | 0.3 m/sec at gate |
| Billet dimension: | 80 mm diameter × 180 mm length |
| Weight of billet: | 2200 g |
| Material: | A357 |

The flow has a very high degree of laminarity.

A series of experiments were performed to assess the quality of parts produced using a design that incorporates the 20° chamfer of the piston chamber section of the injector, as well as the annular skimming as shown in FIG. 2 absent the deflector. It will be noted that the chamfer encircles the piston chamber section, but could be any other section that substantially overlaps with the angular extent of the opening into the ring tank. In all cases the same material (specifically aluminum alloy A357) was used, the billets having been formed in a same manner (e.g. the billets were produced by SEED process), and the injection rates (piston speed around 0.3 m/sec.) were the same. A total of 10 parts were produced, the remnants of which were studied.

Figure 4A:
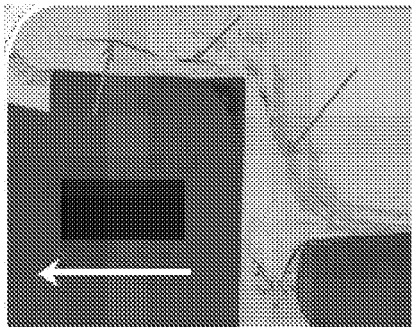
FIG. 4*a* is a micrograph image of a sectioned remnant of a semi-solid metal alloy injected in a prior art injector of FIG. 1.
Figure 4B:
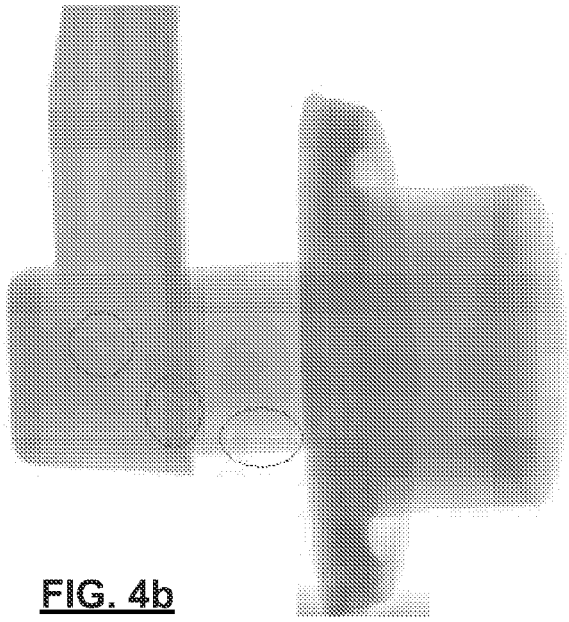
FIGS. 4*b,c* are radiographic images of remnants of a semi-solid metal alloy injected in the prior art injector of FIG. 1, and FIG. 2, respectively.
Figure 4C:
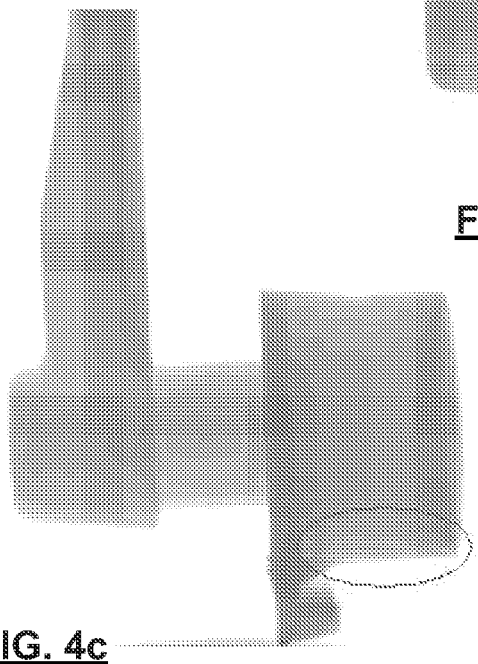

FIGS. 4*a-c* schematically illustrate defects observed in experiments. FIGS. 4*a,b* show part remnants produced using the injector of FIG. 1, whereas FIG. 4*c* shows a part remnant produced according to an embodiment of the present invention. As shown in FIG. 4*c*, radiographic analysis shows effective trapping of the lubricant, as lower density regions were confined to the piston chamber section of the injector. FIG. 4*b* is a direct comparison with that of FIG. 4*a*, that shows lubricant passing through the entry channel. FIG. 4*a* shows a magnified image of the polished sectioned remnant produced using the injector of FIG. 1. FIG. 4*a* shows particularly well the dead zone, and the traveling of the skin into the entry channel.

The comparison tests were done using a same Buhler 530 tone die-casting machine with similarly produced billets, casting 10 parts under each of three different conditions: having a complete blockage of the ring tank to effectively provide no trap; having a complete annular opening as shown in FIG. 1, and having a partial annular opening as provided by inserting the annular ring having ⅓ open and ⅔ closed angular extents.

Figure 5:
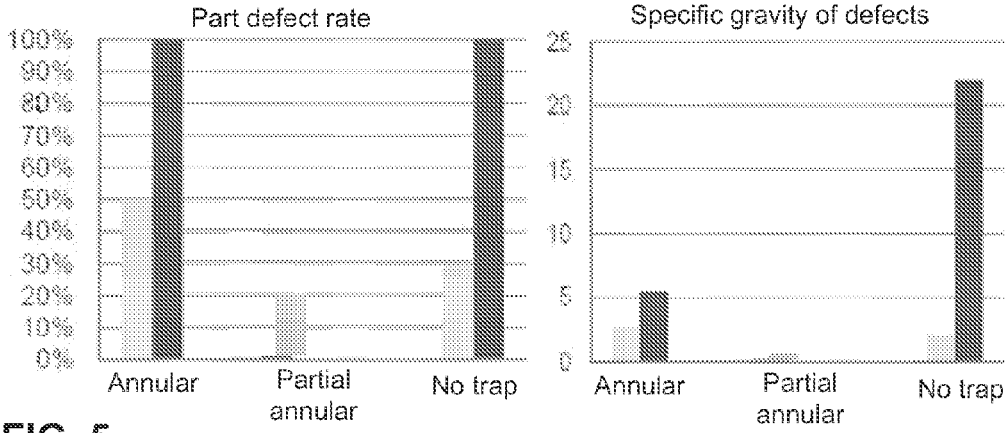
FIG. 5 is a graph indicating comparative reliability data for parts produced using the prior art injectors having no trap, and having an annular trap, in comparison with those produced using an injector having a partial annular skimming trap.

Then, all 30 parts were sent to radiography (for 3D tomography). We observed two types of defects from the 3D tomography: lenticular defects and porosity. The samples were classed according to them. FIG. 5 shows that all of the parts produced without the trap, or with the complete annular opening had porosity defects (dark columns), and that none of the parts with the partial annular opening exhibited these defects. Furthermore, 50% and 30% of the parts made with the complete annular opening and with no trap respectively exhibited lenticular defects (light columns), whereas only 20% did when produced using the partial annular opening. Further analysis on the locations of the defects within the parts with the partial annular opening trap found that on average the parts had defects only within the piston chamber section of the injector (called a "biscuit"), and none had entered the entry to the mold. In contrast, the parts formed with the complete annular opening and without the trap had defects within the entry channel and beyond.

What is claimed is:

1. An injector for injecting a thixotropic billet from a piston chamber into a mold, the injector having a piston chamber segment, an entry channel having a smaller diameter than the piston chamber segment, and, near a periphery of the piston chamber segment proximate the entry channel, an outlet to a trap wherein the outlet extends only 10-70% around an angular extent of a center axis of the injector to provide a partial annular skimmer, further comprising a deflector in an end wall of the injector proximate the outlet, the deflector having at least one of the following:

a recess 1-15 mm deep;

a recess 3-50 mm long; and a recess with a leading edge positioned 0.5-8 mm inward of a wall of the piston chamber segment.

2. The injector of claim 1 wherein the trap is a ring tank that extends around the center axis to a greater angular extent than the outlet.

3. The injector of claim 1 wherein the center axis is oriented horizontally in use.

4. The injector of claim 3 wherein the outlet is centered vertically on a bottom of the injector to gather at least a part of a skin formed on a bottom of the billet.

5. The injector of claim 1 formed of a material to support temperatures of semisolid metal alloy billets.

6. The injector of claim 1 wherein the trap and outlet are formed at an interface between two parts of the injector, a first part substantially defining the end wall of the injector through which the entry channel passes concentric with the axis, and a second part substantially defining a cylindrical wall of the piston chamber segment.

7. The injector of claim 6 wherein:

the trap is a ring tank formed substantially in only one of the two parts;

the trap and outlet are formed by a large annular opening between the two parts in which a ring insert is provided, the ring insert effectively blocking radial flow into the large annular opening, except over the 10-70% angular extent, the ring insert defining at least a radially inner wall of the trap, and one wall of the outlet; or an edge between the cylindrical wall and the outlet is chamfered with an angle of 60° or less to improve flow of at least a part of a skin formed on the billet.

8. A method for removing at least a part of a skin formed on a thixotropic billet during injection of the billet, the method comprising:

thrusting the billet through a constriction in an injector between a piston chamber segment, and an entry channel having a smaller diameter than the piston chamber segment;

skimming the billet to selectively remove at least part of the skin around 10-70% of the periphery of the billet near the constriction by providing an outlet between the piston chamber segment and a trap near a periphery of the piston chamber segment proximate the entry channel; and deflecting the periphery of the billet into the trap with a deflector in an end wall of the injector proximate the outlet, the deflector having at least one of the following: a recess 1-15 mm deep; a recess 3-50 mm long; and a recess with a leading edge positioned 0.5-8 mm inward of a wall of the piston chamber segment, wherein the outlet extends only 10-70% around an angular extent of a center axis of the injector.

9. The method of claim 8 wherein thrusting the billet is facilitated by concentric alignment of the piston chamber segment and entry channel.

10. The method of claim 8 wherein: the billet is formed in a manner consistent with rheocasting of semi-solid metal alloys; an oxide layer is provided on only a bottom surface thereof; and the 10-70% of the billet periphery removed is aligned to remove this oxide layer.

11. The method of claim 8 wherein: thrusting the billet is facilitated by lubricating a piston chamber; the thrusting is performed substantially in a horizontal direction; and the 10-70% of the billet periphery removed is at a bottom of the billet.

12. The method of claim 8 wherein selectively removing comprises guiding the at least part of the skin through the output to the trap with a chamfered edge between the piston chamber segment and a wall through which the entry channel passes.

13. The method of claim 8 further comprising guiding the at least part of the skin through the output by causing the skin to deflect radially and then azimuthally to fill a ring tank that surrounds an axis of the injector,

* * * * *